US006475634B1

(12) United States Patent
Lam

(10) Patent No.: US 6,475,634 B1
(45) Date of Patent: Nov. 5, 2002

(54) COLLECTIBLE ITEM WITH RELIC AND METHOD OF MAKING THE SAME

(75) Inventor: Michael R. Lam, Rancho Mirage, CA (US)

(73) Assignee: Avatar General Corporation, Rancho Mirage, CA (US)

( * ) Notice: Subject to any disclaimer, the term of this patent is extended or adjusted under 35 U.S.C. 154(b) by 0 days.

(21) Appl. No.: 09/307,168

(22) Filed: May 7, 1999

Related U.S. Application Data

(60) Provisional application No. 60/084,726, filed on May 8, 1998.

(51) Int. Cl.[7] ..... A47G 35/00

(52) U.S. Cl. ..... 428/542.4; 40/299.01; 83/13; 283/81; 283/75; 156/60

(58) Field of Search ..... 428/542.2, 542.4, 428/3, 13, 33; 40/299.01; 28/164; 434/82; 83/32, 13; 283/75, 81; 156/60

(56) References Cited

U.S. PATENT DOCUMENTS 2,298,152 A * 10/1942 O'Russa
5,380,047 A * 1/1995 Molee et al.
5,526,597 A * 6/1996 Plotkin et al.
5,577,728 A * 11/1996 Kondo
5,803,501 A 9/1998 Gluck
5,971,435 A * 10/1999 DiCesare et al.

OTHER PUBLICATIONS

"Cutting edge memorabilia all the rage", D. Rovell, Aug. 10, 2000, ESPN.com, pp. 1–6.*

Racing Champions/Press Pass, printed Jun. 14, 2001, www.racingchamps.com, pp. 1 and 2.*

* cited by examiner

*Primary Examiner*—Deborah Jones
*Assistant Examiner*—Wendy Boss
(74) *Attorney, Agent, or Firm*—Fitch, Even, Tabin & Flannery

(57) ABSTRACT

An article of manufacture associated with a celebrity includes a collectible item, a relic fragment, and a certificate of authenticity. The relic fragment is formed from a relic associated with the celebrity. The collectible item is joined with the relic fragment. A unique identifier is assigned to the relic fragment. The certificate of authenticity attests to the authenticity of the relic fragment and includes the unique identifier.

6 Claims, 4 Drawing Sheets

COLLECTIBLE ITEM WITH RELIC AND METHOD OF MAKING THE SAME

RELATED APPLICATIONS

This application claims the benefit of Provisional Application Ser. No. 60/084,726, filed May 8, 1998.

FIELD OF THE INVENTION

This invention relates to collectible items and methods of making the same, and, in particular embodiments, collectible items with relics and methods of making the same.

BACKGROUND OF THE INVENTION

Generally, collectible items (such as dolls, toys, figurines, books, and the like) are commercially available for purchase by consumers. Relics, or objects owned and/or used by celebrities (such as articles of clothing, fashion accessories, utensils, furniture, books, works of art, manuscripts, letters, and the like), are also commercially available for purchase by consumers. However, collectible items and relics (or relic fragments) are traditionally sold separately. It would be desirable to join a collectible item together with a relic (or a relic fragment) into a single article of manufacture, and thus, enhance the value and consumer appreciation of the collectible item and the relic joined into the single article over the collectible item and the relic as separately sold.

SUMMARY OF THE DISCLOSURE

It is an object of embodiments of the present invention to provide an improved article of manufacture which includes a collectible item with a relic and a method of making the same, which obviate for practical purposes, the above mentioned limitations.

According to an embodiment of the present invention, an article of manufacture associated with a celebrity includes a collectible item, a relic fragment, and a certificate of authenticity. The relic fragment is formed from a relic associated with the celebrity. The collectible item is joined with the relic fragment. A unique identifier is assigned to the relic fragment. The certificate of authenticity attests to the authenticity of the relic fragment and includes the unique identifier. In particular embodiments of the present invention, the certificate of authenticity further includes a signature of an expert qualified to represent that the relic was owned and/or used by the celebrity and a signature of a manufacturer of the article.

In another embodiment of the present invention, an article of manufacture associated with a celebrity includes a collectible item, a label, and a relic fragment. The label is coupled to the collectible item. The relic fragment is formed from a relic associated with the celebrity and is coupled within a first portion of the label. A unique identifier is assigned to the relic fragment and is applied to a second portion of the label. In particular embodiments of the present invention, the article of manufacture further includes a certificate of authenticity for attesting to the authenticity of the relic fragment and including the unique identifier.

In still another embodiment of the present invention, a method of making an article of manufacture associated with a celebrity includes the following steps: (1) forming a relic fragment from a relic associated with the celebrity; (2) joining a collectible item with the relic fragment; (3) assigning a unique identifier to the relic fragment; and (4) creating a certificate of authenticity for attesting to the authenticity of the relic fragment and including the unique identifier. In particular embodiments of the present invention, the step of joining a collectible item with the relic fragment further includes the steps of: (a) preparing a mixture of the relic fragment and at least one base material; and (b) forming the collectible item from the mixture of the relic fragment and the at least one base material. In other embodiments of the present invention, the step of joining a collectible item with the relic fragment further includes the steps of: (a) providing the collectible item; and (b) attaching the relic fragment to the collectible item.

In yet another embodiment of the present invention, a method of making an article of manufacture associated with a celebrity includes the following steps: (1) forming a relic fragment from a relic associated with the celebrity; (2) providing a collectible item; (3) coupling the relic fragment within a first portion of a label; (4) assigning a unique identifier to the relic fragment; (5) applying the unique identifier to a second portion of the label; and (6) coupling the label to the collectible item. In particular embodiments of the present invention, the method further includes the step of creating a certificate of authenticity for attesting to the authenticity of the relic fragment and including the unique identifier.

Other features and advantages of the invention will become apparent from the following detailed description, taken in conjunction with the accompanying drawings, which illustrate, by way of example, various features of embodiments of the invention.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
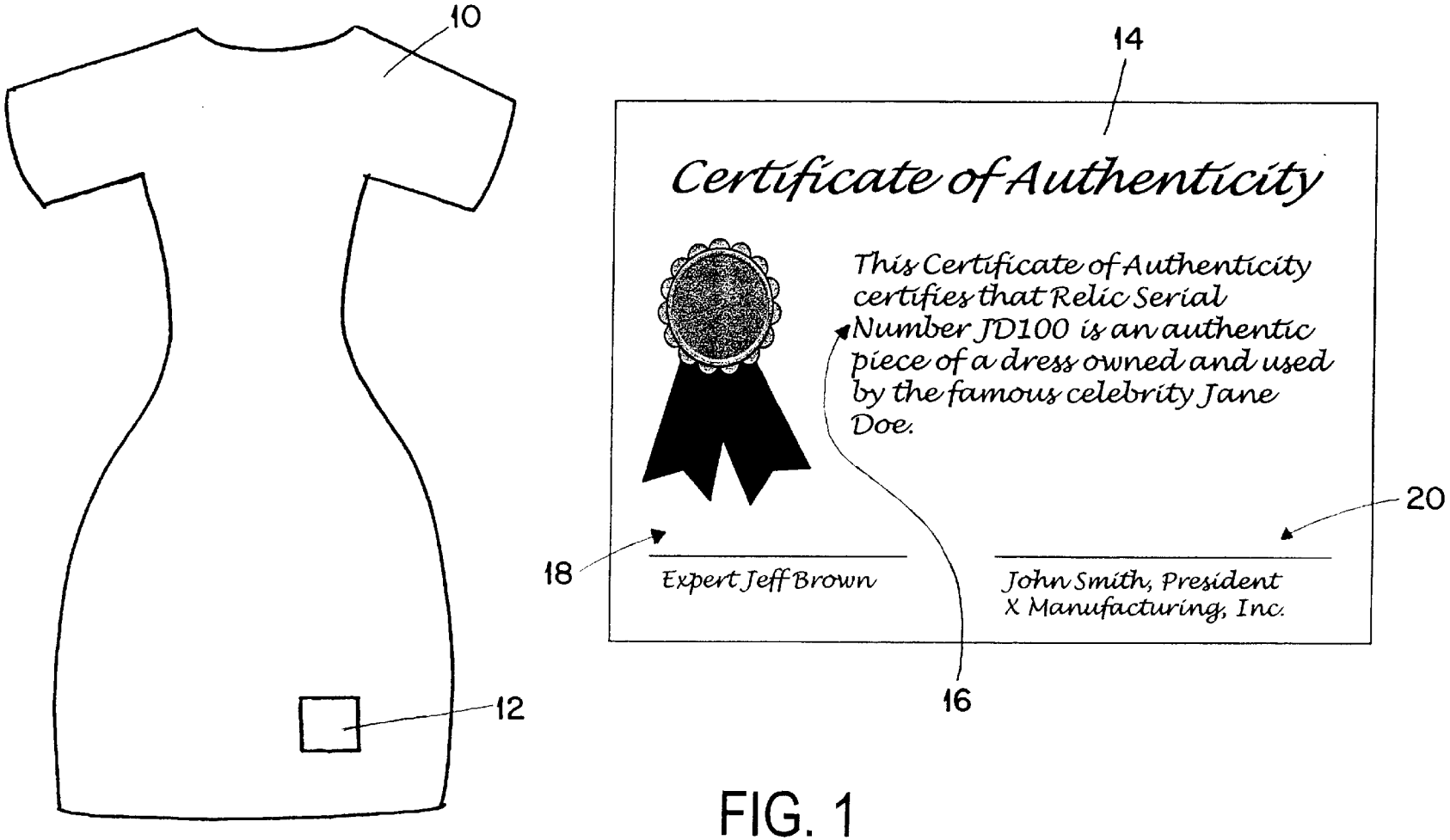
FIG. 1 is a perspective view of a collectible item with a relic in accordance with a first embodiment of the present invention.

As shown in the drawings for purposes of illustration, the invention is embodied in a collectible item with a relic and a method of making the same. In preferred embodiments of the present invention, the collectible item is a doll, and the relic is an object formerly owned and/or used by a celebrity, such as an article of clothing. A relic fragment is formed from the relic and attached to a dress for the doll. However, it will be recognized that further embodiments of the invention may use other types of collectible items and relics, and may join the collectible item with the relic fragment in other manners. In alternative embodiments, the collectible items may be toys, figurines, books, or the like. In further alternative embodiments, the relics may be other types of objects formerly owned and/or used by celebrities, such as fashion accessories, utensils, furniture, books, works of art, manuscripts, letters, or the like. In yet other alternative embodiments, the collectible item may be joined with the relic fragment in other manners, such as incorporating the relic fragment into the collectible item itself, or the like.

FIG. 1 illustrates a collectible item with a relic in accordance with a first embodiment of the present invention. In the illustrated embodiment, the collectible item is a doll (not shown), and the relic is an article of clothing owned and/or used by a celebrity. A relic fragment 12 formed from the relic is preferably square in shape, but may also be rectangular, circular, triangular, or the like. The relic fragment 12 is attached to an inside surface of a dress 10 for the doll. However, in alternative embodiments, the relic fragment 12 may be attached to an outside surface of the dress 10. In other alternative embodiments, the relic fragment 12 may be incorporated into the collectible item itself.

As shown in FIG. 1, a unique serial number 16 is assigned to the relic fragment 12 and is included on a certificate of authenticity 14. The certificate of authenticity 14 includes two signatures: (1) the signature 18 of an expert fully qualified to represent that the relic was owned and/or used by the celebrity, and (2) the signature 20 of the manufacturer of the collectible item with the relic. Each signature may be either an original signature or a copy of the original signature. The certificate of authenticity 14 attests to the identity and the source of the relic and thus attests to the authenticity of the relic fragment 12. In alternative embodiments, the serial number 16 may be other unique alphabetic, numeric, or the like identifiers. In further alternative embodiments, the serial number 16 may also be applied directly onto the relic fragment 12. In other alternative embodiments, the serial number 16 and the certificate of authenticity 14 may be omitted.

Figure 2:
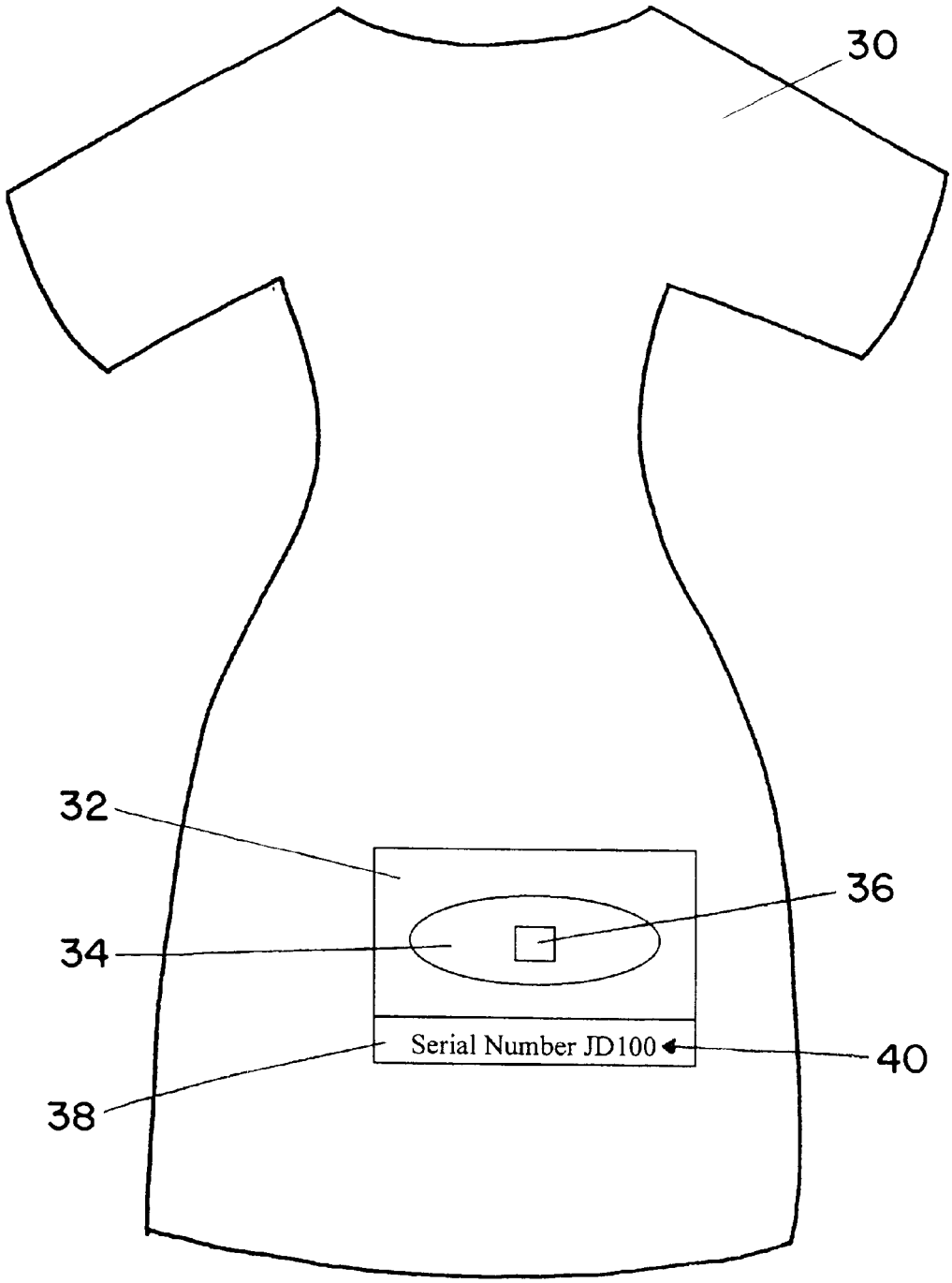
FIG. 2 is a perspective view of a collectible item with a relic in accordance with a second embodiment of the present invention.

FIG. 2 illustrates a collectible item with a relic in accordance with a second embodiment of the present invention. In the illustrated embodiment, the collectible item is a doll (not shown), and the relic is an article of clothing owned and/or used by a celebrity. A relic fragment 36 formed from the relic is preferably square in shape. The relic fragment 36 is attached to an inside surface of a dress 30 for the doll. However, in alternative embodiments, the relic fragment 36 may be attached to an outside surface of the dress 30.

As shown in FIG. 2, a rectangular label 32 is attached to the inside surface of the dress 30. In the illustrated embodiment, the label 32 has a first, oval-shaped portion 34 at about the center of the label 32. The relic fragment 36 is attached within the portion 34 of the label 32. The label 32 also has a second, rectangular portion or strip 38 of preferably clear material at about the bottom of the label 32. In alternative embodiments, the label 32, the portion 34, the relic fragment 36, and the strip 38 may have other shapes, such as circular, triangular, or the like. In further alternative embodiments, the portion 34 and the strip 38 may be located at different places on the label 32.

In the embodiment illustrated in FIG. 2, a unique serial number 40 is assigned to the relic fragment 36 and is applied to the strip 38. In alternative embodiments, the serial number 40 may also be included on a certificate of authenticity 14 as shown in and described with reference to FIG. 1. In further alternative embodiments, the serial number 40 may be other unique alphabetic, numeric, or the like identifiers. In other alternative embodiments, the serial number 40 may be applied directly onto the label 32 and/or the relic fragment 36, and the strip 38 may be omitted. In yet other alternative embodiments, the serial number 40 and the strip 38 on the label 32 may be omitted.

Figure 3:
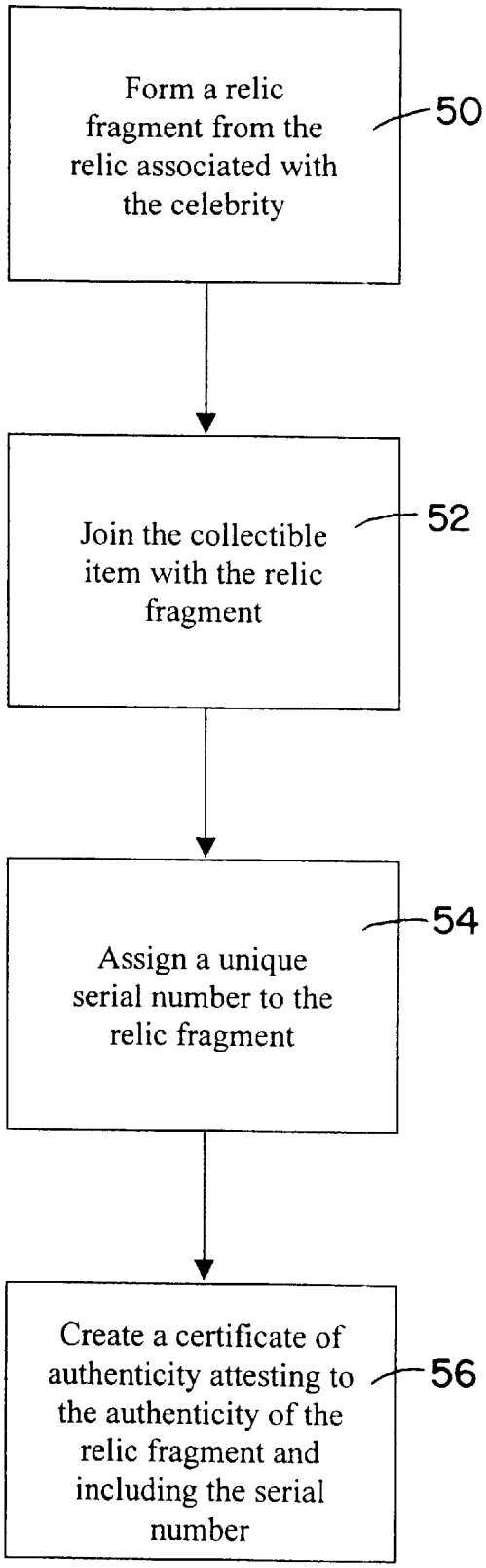
FIG. 3 is a flowchart describing a method of making the collectible item with the relic shown in FIG. 1.

With reference to FIG. 3, a method of making the collectible item with the relic shown in FIG. 1 will now be described. The collectible item is a doll (not shown), and the relic is an article of clothing owned and/or used by a celebrity. At step 50, a relic fragment is formed from the relic associated with the celebrity. In preferred embodiments, the relic fragment is formed by cutting the relic into square fragments. However, in alternative embodiments, the relic fragment may be formed using other processes, such as shredding, grinding, smashing, milling, or the like. In further alternative embodiments, a plastizer or other stiffening agent may be added to the relic prior to cutting the relic into fragments. The stiffening agent adds body and strength to the relic and facilitates cutting the relic into fragments.

At step 52, the collectible item is joined with the relic fragment. In preferred embodiments, the relic fragment is attached to the collectible item using processes such as heat transfer, sewing, or the like. For example, the relic fragment is attached to a dress for the doll. However, in alternative embodiments, the relic fragment may be attached to the collectible item using fasteners, adhesives, or the like. In other alternative embodiments, the relic fragment may be incorporated into the collectible item itself by preparing a mixture of the relic fragment and at least one base material and then forming the collectible item from such mixture. For example, a mixture of the relic fragment and at least one base material, such as plastic or plastisol, ceramic, porcelain, metal, or the like, may be prepared, and then the collectible item may be formed from such mixture.

At step 54, a unique serial number (or other unique alphabetic, numeric, or the like identifier) is assigned to the relic fragment. At step 56, a certificate of authenticity for attesting to the authenticity of the relic fragment is created. The certificate of authenticity includes the serial number and is signed by two people: (1) an expert fully qualified to represent that the relic was owned and/or used by the celebrity, and (2) the manufacturer of the collectible item with the relic. In alternative embodiments, the serial number may also be applied directly onto the relic fragment using processes such as heat transfer, sewing, stamping, etching, or the like. In other alternative embodiments, the serial number and the certificate of authenticity may be omitted.

Figure 4:
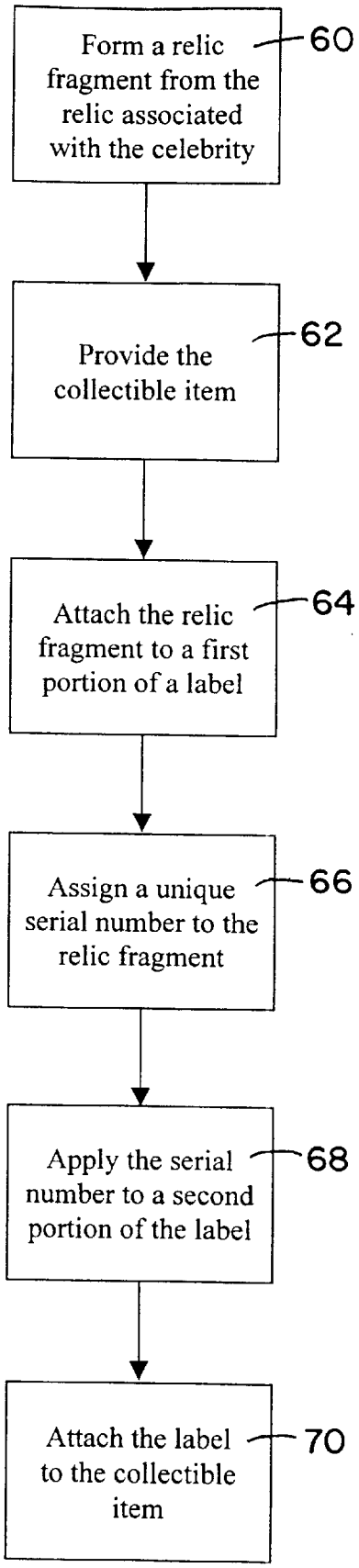
FIG. 4 is a flowchart describing a method of making the collectible item with the relic shown in FIG. 2.

With reference to FIG. 4, a method of making the collectible item with the relic shown in FIG. 2 will now be described. The collectible item is a doll (not shown), and the relic is an article of clothing owned and/or used by a celebrity. At step 60, a relic fragment is formed from the relic associated with the celebrity. In preferred embodiments, the relic fragment is formed by cutting the relic into square fragments. However, in alternative embodiments, the relic fragment may be formed using other processes, such as shredding, grinding, smashing, milling, or the like. In further alternative embodiments, a plastizer or other stiffening agent may be added to the relic prior to cutting the relic into fragments. The stiffening agent adds body and strength to the relic and facilitates cutting the relic into fragments.

At step 62, the collectible item is provided. At step 64, the relic fragment is attached within a first portion of a label at about the center of the label, preferably using processes such as heat transfer, sewing, or the like. At step 66, a unique serial number (or other unique alphabetic, numeric, or the like identifier) is assigned to the relic fragment. At step 68, the serial number is applied to a second portion of the label at about the bottom of the label, preferably using processes such as heat transfer, sewing, or the like. In preferred embodiments, the serial number is applied to a strip on the label. However, in alternative embodiments, the serial number may be applied directly onto the label and/or the relic fragment using processes such as heat transfer, sewing, stamping, etching, or the like, and the strip on the label may be omitted. In other alternative embodiments, the serial number and the strip on the label may be omitted. At step 70, the label is attached to the collectible item, preferably using processes such as heat transfer, sewing, or the like. In further alternative embodiments, a certificate of authenticity for attesting to the authenticity of the relic fragment and including the serial number may also be created. In other alternative embodiments, the relic fragment may be attached within the label, the serial number may be applied to the label, and the label may be attached to the collectible item, using fasteners, adhesives, or the like.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An article of manufacture associated with a celebrity, the article comprising:

a collectible item;

a label coupled to the collectible item;

a relic fragment cut from a relic associated with the celebrity and stiffened by an agent added thereto, wherein the relic fragment is coupled within a first portion of the label; and a unique identifier assigned to the relic fragment, wherein the unique identifier is applied to a second portion of the label.

2. The article of claim 1, further comprising a certificate of authenticity for attesting to the authenticity of the relic fragment, wherein the certificate of authenticity includes the unique identifier.

3. The article of claim 2, wherein the certificate of authenticity further includes:

a signature of an expert qualified to represent that the relic was owned or used by the celebrity; and a signature of a manufacturer of the article.

4. The article of claim 1, wherein the relic fragment includes the unique identifier.

5. A method of making an article of manufacture associated with a celebrity, the method comprising the steps of:

adding a stiffening agent to a relic associated with the celebrity;

cutting the relic into a plurality of relic fragments;

providing a collectible item;

coupling one of the relic fragments within a first portion of a label;

assigning a unique identifier to the relic fragment;

applying the unique identifier to a second portion of the label; and coupling the label to the collectible item.

6. The method of claim 5, further comprising the step of:

creating a certificate of authenticity for attesting to the authenticity of the relic fragment, wherein the certificate of authenticity includes the unique identifier.

* * * * *